US005446235A

United States Patent [19]

Shih et al.

[11] Patent Number: 5,446,235

[45] Date of Patent: Aug. 29, 1995

[54] DRAWER AND LID ACTIVATED MUSICAL ROTATING ORNAMENT

[76] Inventors: Bohr-Winn Shih, 2597 Sumac La., Boise, Id. 83706; Barry Shih, 2F, No. 321, Pateh Road, Sec. 4, Taipei 10563, Taiwan

[21] Appl. No.: 289,417

[22] Filed: Aug. 12, 1994

Related U.S. Application Data

[63] Continuation-in-part of Ser. No. 145,327, Oct. 29, 1993.

[51] Int. Cl.[6] ..... G10F 1/06

[52] U.S. Cl. ..... 84/95.2; 446/404; 446/482

[58] Field of Search ..... 84/94.1, 94.2, 95.1, 84/95.2; 40/414; 446/479, 482, 404

[56] References Cited

U.S. PATENT DOCUMENTS 2,807,118 9/1957 Reuge ..... 84/95.2 X
4,193,648 3/1980 Gargiulo ..... 84/94.2 X

*Primary Examiner*—M. C. Gellner
*Assistant Examiner*—Patrick J. Stanzione
*Attorney, Agent, or Firm*—Frank J. Dykas; Craig M. Korfanta

[57] ABSTRACT

A musical article of furniture, here jewelry armoire (10') which includes a pivotal lid (38') for activating and deactivating a musical movement (19). Mechanical spring wound musical movement (19) is attached to a supporting surface (14') which in turn is attached to lid (38'). Musical movement (19) includes a rotating shaft, also serving as the winding shaft (21), protruding through a top surface of supporting surface (14'). An ornament (34) is affixed to the shaft and the shaft is decoratively finished. Musical movement (19) is provided with a stop-and-start mechanism which includes a control arm (22') being positioned and configured to interfere with the back of housing (39') such that the mechanism will be activated when lid (38') is opened and will shut off when the lid is closed.

5 Claims, 11 Drawing Sheets

DRAWER AND LID ACTIVATED MUSICAL ROTATING ORNAMENT

RELATED APPLICATIONS

This application is a continuation-in-part application of application Ser. No. 08/145,327, filed Oct. 23, 1993.

BACKGROUND OF THE INVENTION

1. Technical Field

This invention generally relates to musical movements as they are applied to furniture. More particularly, this invention relates to a musical movement having a rotating ornament which is activated by a lid on, or a drawer in, an article of furniture.

2. Background Art

Traditional music boxes are of a standard box-like configuration and include a mechanical spring wound musical movement which is activated by opening the box lid or opening a drawer. A separate winding key is provided through one side or the bottom of the box to tension the spring movement. These music boxes can be and are configured to serve as a place for storing jewelry, trinkets and other small valuables.

It would be desirable to provide an article of furniture such as a jewelry chest or jewelry armoire, which does not have a separate winding key and which includes a rotating ornament.

DISCLOSE OF INVENTION

It is therefore an object of the present invention to provide an article of furniture with a musical movement without a traditional winding key. It is a further object of this invention to-provide an article of furniture having a storage drawer which stops and starts the musical movement. It is a further object of this invention to provide an article of furniture having a lid which stops and starts the musical movement. Still, a further object of the present invention is to provide a decorative shaft for winding the musical movement, which serves an additional ornamental purpose by supporting an ornament on the rotating decorative shaft.

These objects and others are accomplished by an article of furniture which is highly ornamental in appearance and includes at least one slidable drawer or a lid, for activating and deactivating the musical movement. A mechanical spring wound musical movement is attached to a supporting surface of the housing of the furniture article and has a rotating shaft, also serving as the winding shaft, protruding through an exposed surface of the furniture article. An ornament is affixed to the shaft and the shaft is decoratively finished.

The musical movement is provided with a stop-and-start mechanism which serves to activate the musical movement when either a drawer, or a lid, is opened and which serves to deactivate the musical movement when either the drawer or the lid is closed.

In the case of the drawer activated movement, the stop and start mechanism includes a control arm being positioned and configured to interfere with the back of the drawer such that the mechanism will be activated when the drawer is opened and will shut off when the drawer is closed. The control arm pivots between the on and off positions about a pivot lug which is attached to the underside of the musical movement. An upper portion of the control arm interferes with a radial flywheel type stopper to deactivate the mechanism.

In the case of the lid activated movement, a spring loaded resilient "J" shaped control arm is attached adjacent the musical movement. In a first embodiment of the lid activated movement, both the "J" shaped control arm and the musical movement are attached to a perpendicular supporting surface, which itself is attached to the lid of the jewelry armoire. The "J" shaped control arm is spring biased toward the active or "on" position via its shape and make-up. The "J" shaped control arm interferes with the back side of the armoire, to which the lid is attached, when the lid is in the closed position, to deactivate the musical movement. This is facilitated by the distal end if the "J" shaped control arm interfering with the stopper. Conversely, when the lid is raised, the "J" shaped control arm springs downward and out of the way of the stopper, allowing the musical movement to operate.

In a second embodiment of the lid activated movement, a foreshortened control arm is attached to the back side of the jewelry armoire and positioned to interfere with the stopper only when the lid is in the closed position.

The stopper is axially affixed to a vertically disposed control shaft which has a helical worm gear at its upper end. The helical worm gear engages a large control gear affixed to a control shaft which has, at its other end, a small control gear meshedly engaged with the drive drum gear of the musical movement. The upper end of the control arm prevents the radial stopper from rotating, which in turn prevents the drum drive gear from rotating, thereby keeping the musical movement from operating.

BEST MODE FOR CARRYING OUT INVENTION

Figure 1:
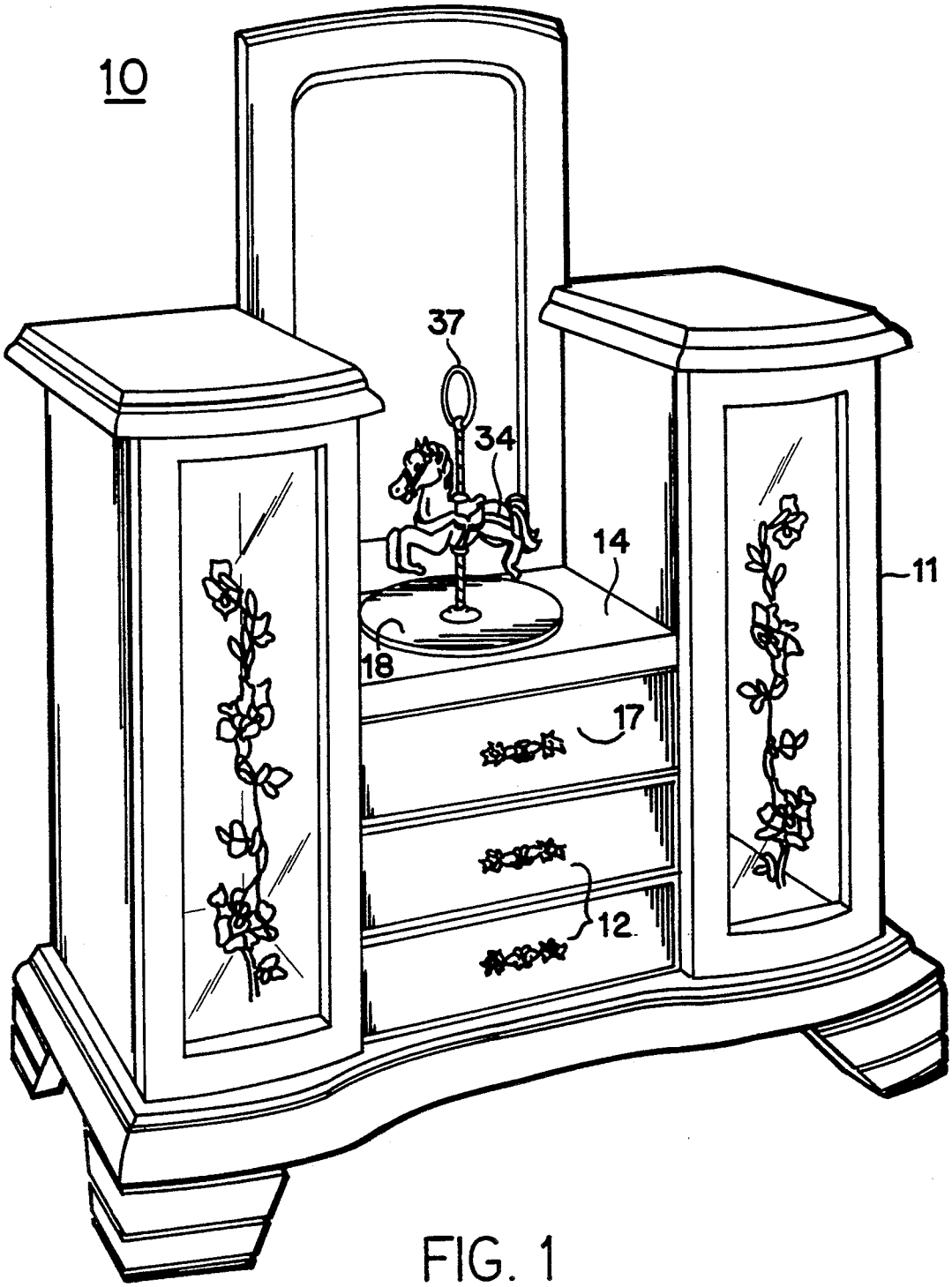
FIG. 1 is a front elevation view of a drawer activated musical jewelry chest, according to the principles of the present invention.
Figure 2:
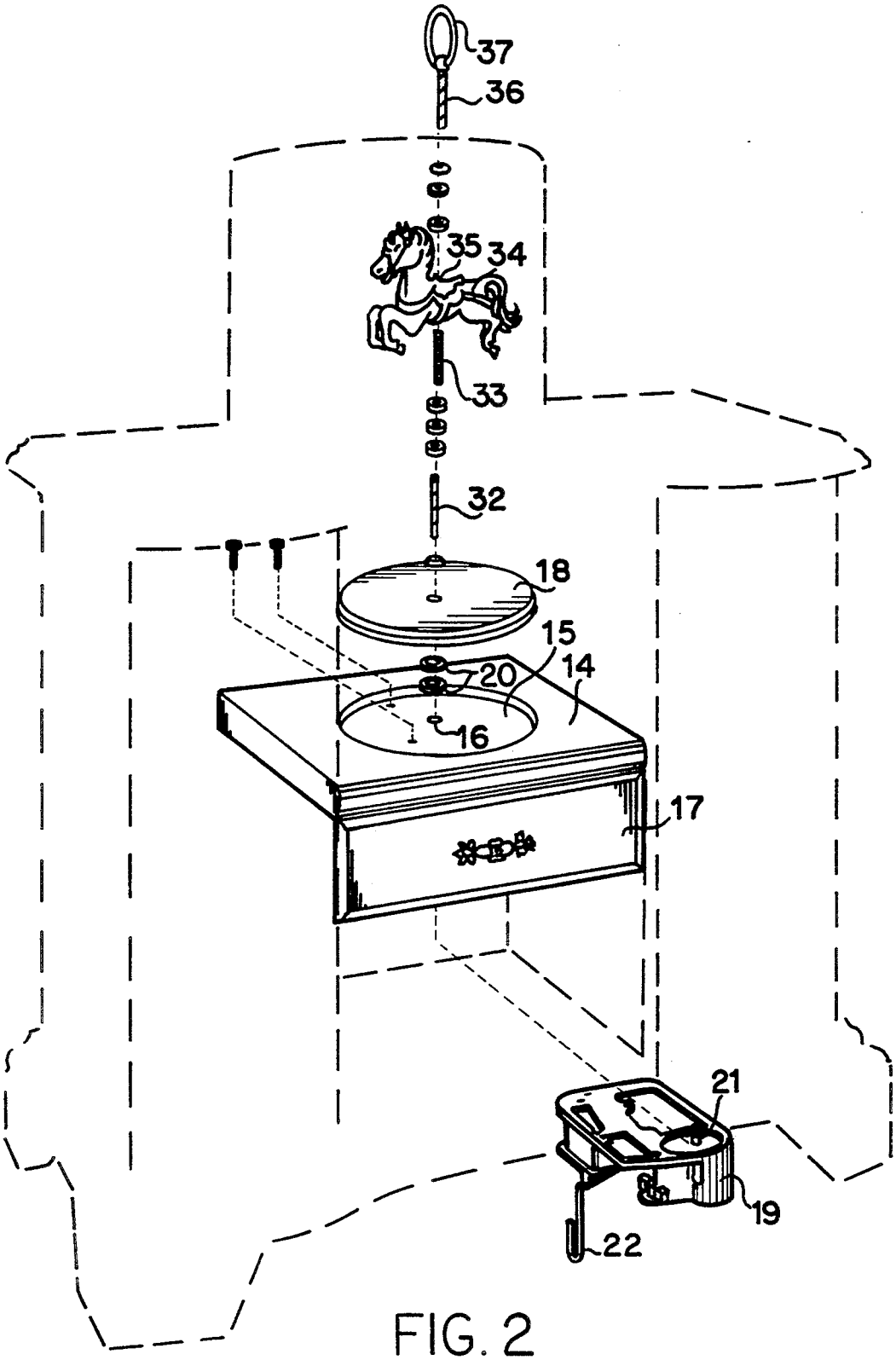
FIG. 2 is a front partially exploded view of the drawer activated musical jewelry chest.
Figure 3:
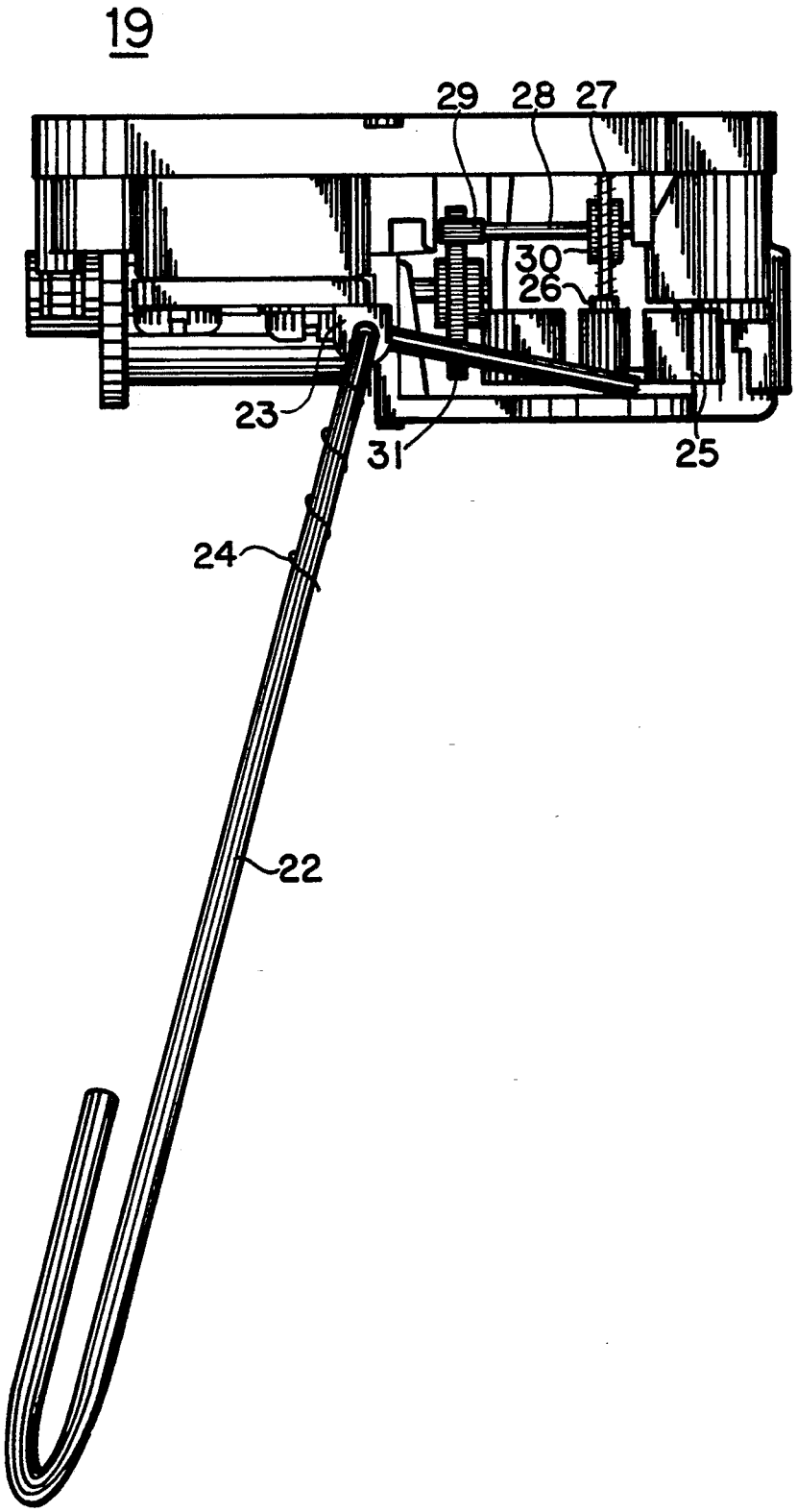
FIG. 3 is a side view of musical movement.
Figure 4:
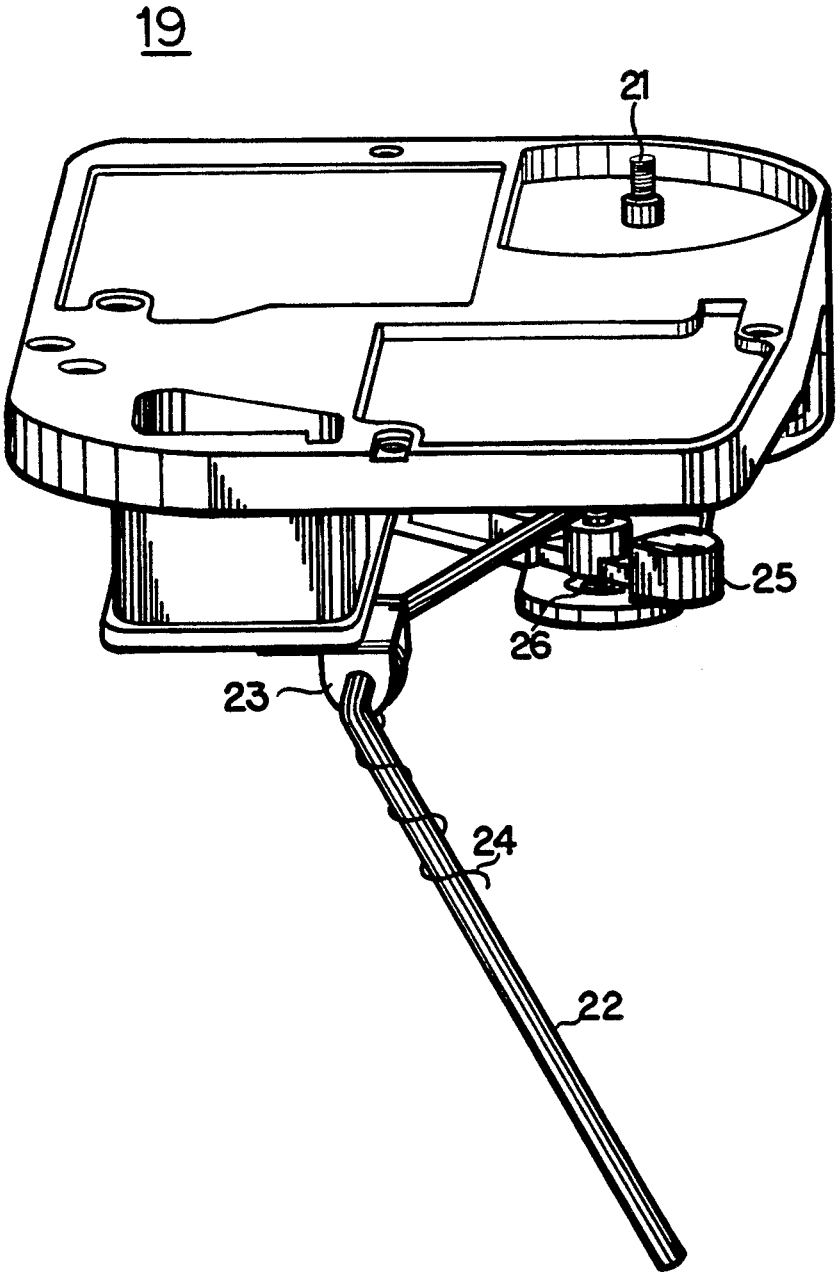
FIG. 4 is a side elevation view of the musical movement.
Figure 5:
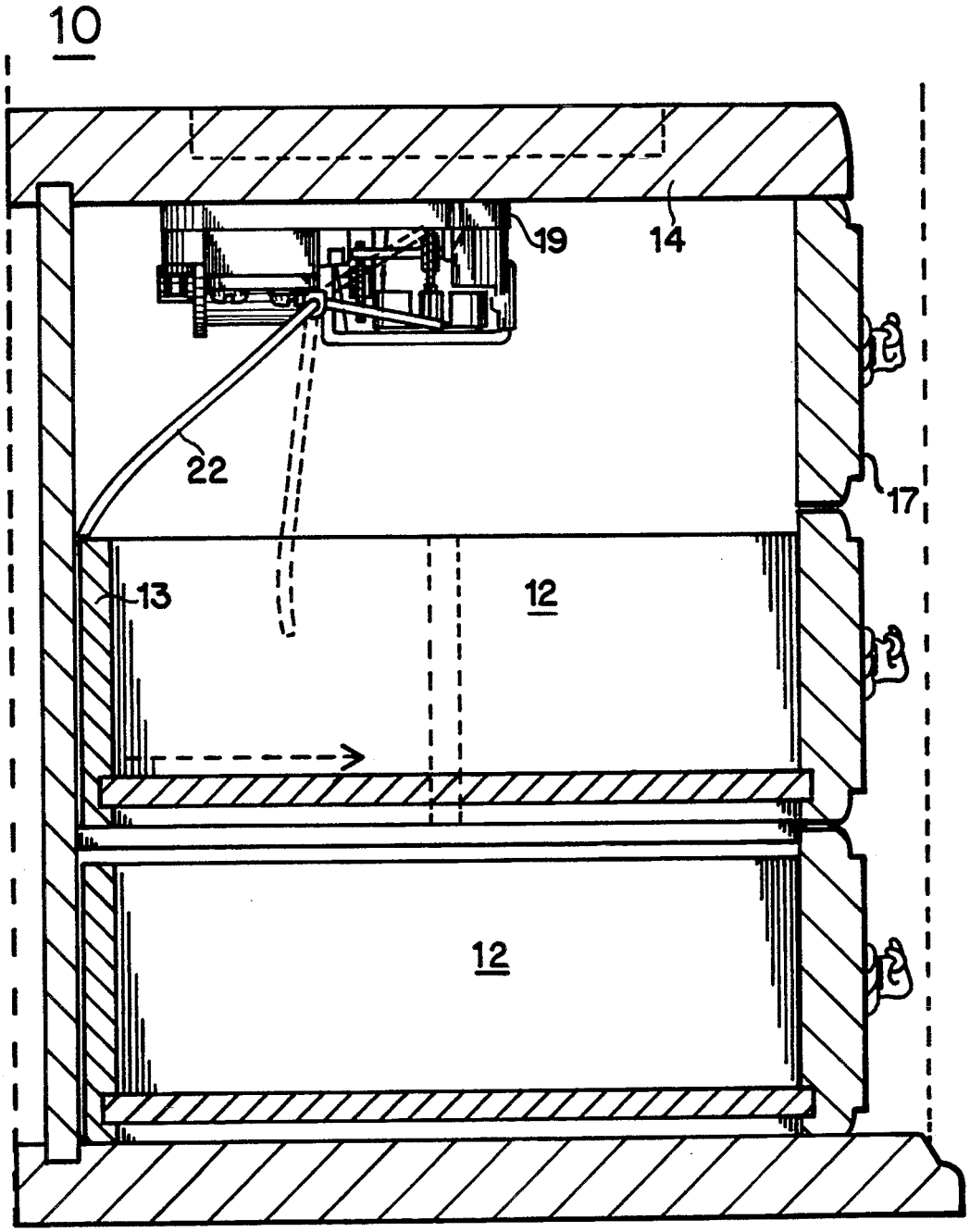
FIG. 5 is a partial side cut-away view of the drawer activated musical jewelry chest.
Figure 6:
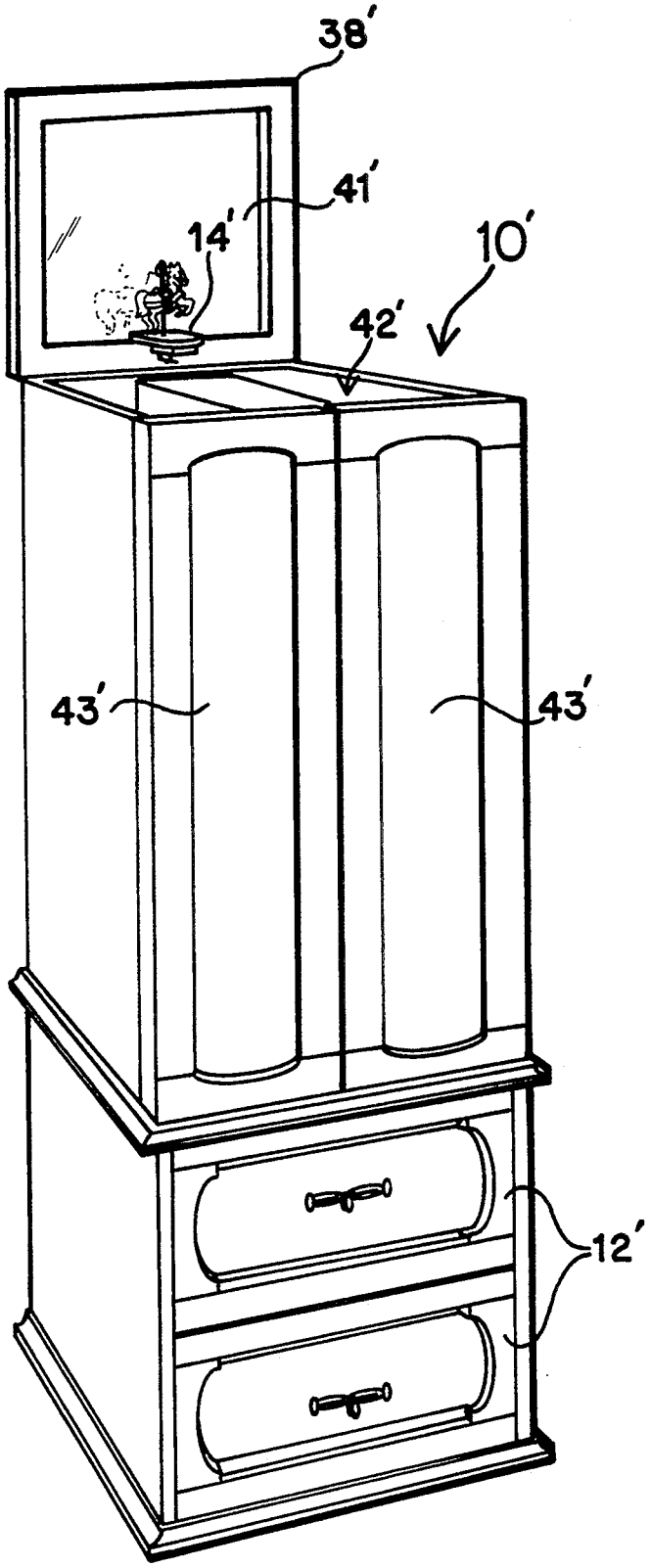
FIG. 6 is a front elevation view of a first embodiment of a lid activated musical jewelry armoire, according to the principles of the present invention.

Referring now to FIGS. 1–5, a drawer-activated jewelry chest is illustrated in detail and generally designated as 10, however it should be apparent that the invention is not limited solely to jewelry chests and can be adapted to many furniture articles, such as the lid activated jewelry armoire described later. Drawer activated jewelry chest 10 includes a chest housing 11, here manufactured out of wood and glass, which is configured to be highly ornamental in appearance. Chest housing 11 includes a pair of drawers 12 for holding jewelry and other trinkets. Top member 14 acts as the musical movement supporting member and includes an annular plate recess 15. A decorative drawer plate 17 is provided along the front edge of musical movement supporting member 14 to form a hidden area directly under member 14 to house spring wound musical movement 19. Annular plate recess 15 is shaped and sized to receive disk-like ornament plate 18.

Spring wound musical movement 19 is attached to the underside of musical movement supporting member 14, using screws or the like, and has winding shaft 21 protruding up through winding shaft hole 16 in annular plate recess 15. Ornament plate 18 rests on a pair of thrust bearing washers 20 which are placed on the threaded stud of winding shaft 21. An ornament shaft, here composed of lower shaft extension 32, intermediate shaft extension 33 and an upper shaft extension 36, is attached to winding shaft 21 to support ornament 34 and to facilitate winding of musical movement 19.

Lower shaft extension 32 extends upward from winding shaft 21. Lower shaft extension 32 is here a brass tube which has threads circumvolving the inside of ends, the lower end being for threaded engagement with winding shaft 21. An intermediate shaft extension 33 is threadedly engaged within the upper end of lower shaft extension 32. Intermediate shaft extension 33 extends through intermediate shaft hole 35 in ornament 34. The upper end of intermediate shaft extension 33 is a threaded stud to which an upper shaft extension 36 is threadedly engaged. Upper shaft extension 36 is here also a brass tube which has threads circumvolving the inside surface of its lower end. A winding ring 37, alternatively a knob or the like, is radially fixed to the upper end of upper shaft extension 36 to facilitate winding of winding shaft 21.

Ornament 34 is here a porcelain carousel horse. It should be apparent that other decorative ornaments could be used as well, as could other compositions for the ornaments. The upper end of power shaft extension 32 and the lower end of upper shaft extension 36 act to rigidly and radially affix ornament 34 on the axis of rotation of winding shaft 21. Similarly, the lower end of lower shaft extension 32, engages the upper surface of ornament plate 18 to axially affix it about winding shaft 21, such that the ornament rotates with the shaft.

Spring wound musical movement 19 is a standard spring wound musical movement with the exception of the stop and start mechanism. The stop and start mechanism includes an "L" shaped control arm 22 which is pivotally attached via pivot lug 23 to the underside of spring wound musical movement 19. L-shaped control arm 22 includes an upper distal end which is configured to interfere with a radial rubber stopper 25 which is affixed to vertical stopper shaft 26.

L-shaped control arm 22 is spring biased in its "on" position via torsion spring 24 which interacts with L-shaped control arm 22 and pivot lug 23. This position corresponds to top drawer 12 being open. When the lower end of L-shaped control arm 22 is pushed backward away from the front of chest housing 11, the upper end of L-shaped control arm 22 will interfere with radial rubber stopper 25. This position corresponds to the top drawer 12 being closed.

Radial rubber stopper 25 is axially affixed to the lower end of vertical stopper shaft 26. The upper end of vertical stopper shaft 26 has a worm gear 27 which is in meshed engagement with a large control gear 30 on control shaft 28. The opposite end of control shaft 28 has a small control gear 29 meshedly engaged with music drum drive gear 31. The gear ratio between worm gear 27, large control gear 30, small control gear 29 and music drum drive gear 31 is selected such that a very light interference with radial rubber stopper 25 will stop music drum drive gear 31 from rotating.

In use, the user winds musical movement 19 by rotating winding ring 37 about the axis of rotation of winding shaft 21. Once musical movement 19 is wound up, upper drawer 12 is opened, which allows L-shaped control arm 22 to pivot to its on position, it being pushed forward by torsion spring 24. To shut the music off, the user simply pushes lower drawer 12 to its closed position.

Referring also now to FIGS. 6–10, a lid activated musical jewelry armoire 10' is shown. Lid activated jewelry armoire 10' includes an armoire housing 11', here manufactured out of wood, which is configured to be highly ornamental in appearance. Armoire housing 11' includes a divided top compartment 42' for holding jewelry and other trinkets, as well as a pair of front doors 43' covering a central storage compartment and a pair of drawers 12' at its bottom. A lid 38' is pivotally attached to the top of a back member 39' of housing 11' between a closed position where lid 38' covers top compartment 42' and an open position which has lid 38' essentially parallel with back housing member 39'. A musical movement supporting member 14' is perpendicularly attached to the inside surface of lid 38'. The inside surface of lid 38' also has a mirror 41' attached thereto for both decorative and functional purposes.

Spring wound musical movement 19 is attached to the underside of musical movement supporting member 14', using screws or the like, and has winding shaft 21 protruding up through a winding shaft hole in support member 14'. The construction of spring wound musical movement 19 is the same as before, as is the construction of the ornamental shaft and ornament, with the exception of the elimination of the ornament plate. However, the stop and start mechanism here includes a resilient, spring loaded generally "J" shaped control arm 22' which is attached to the underside of support member 14'. J-shaped control arm 22' includes a distal end of the "J" portion which is configured to interfere with radial rubber stopper 25 affixed to vertical stopper shaft 26 when lid 38' is in its closed position.

Figure 7:
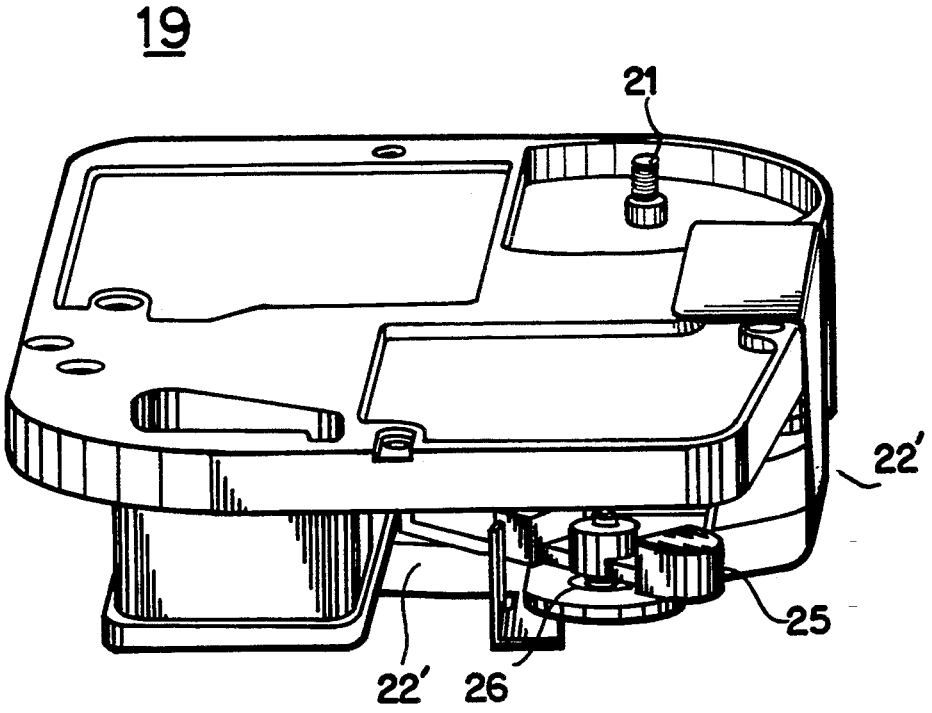
FIG. 7 is a detail view of the first embodiment of the lid activated musical jewelry armoire.

J-shaped control arm 22' is spring biased in its "on" position via its shape and make-up. Here, control arm 22' is manufactured from a thin metal strip, such as a light gauge of stainless steel, and bent into the shape as is best shown in FIG. 7. The position of J-shaped control arm 22' shown in FIG. 7 corresponds to lid 38' being closed with the bottom side of J-shaped control arm 22' interfering with the inside surface of back housing member 39' causing the distal end of J-shaped control arm 22' to interfere with radial rubber stopper 25.

Figure 8:
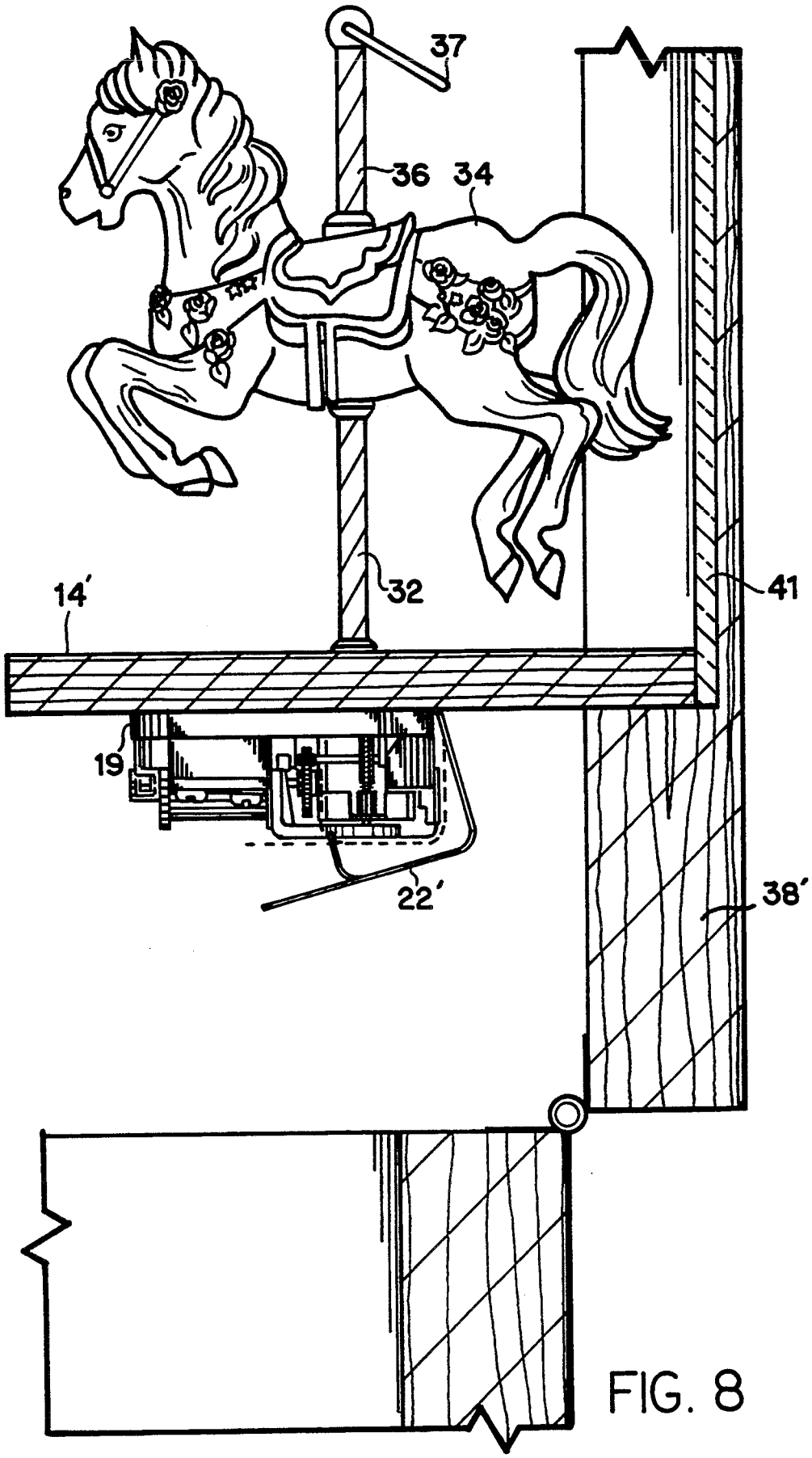
FIG. 8 is a cross section detail view of the first embodiment of the lid activated musical jewelry armoire.

The position of control arm 22' shown in FIG. 8 corresponds to lid 38' being open and musical movement 19 being activated. J-shaped control arm 22' is shaped and configured to be spring biased in this position.

Figure 9:
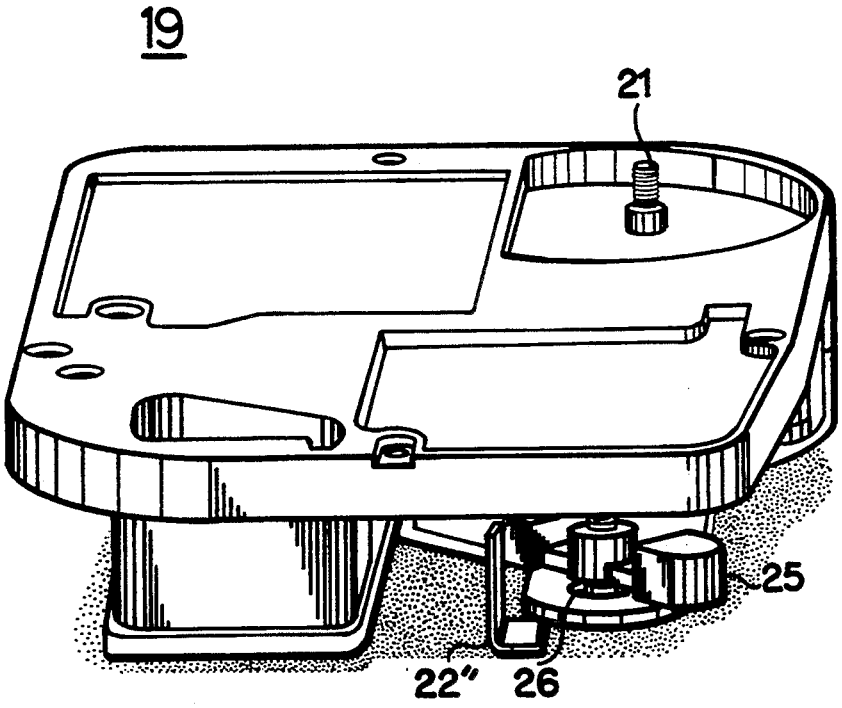
FIG. 9 is a detail view of the second embodiment of the lid activated musical jewelry armoire.
Figure 10:
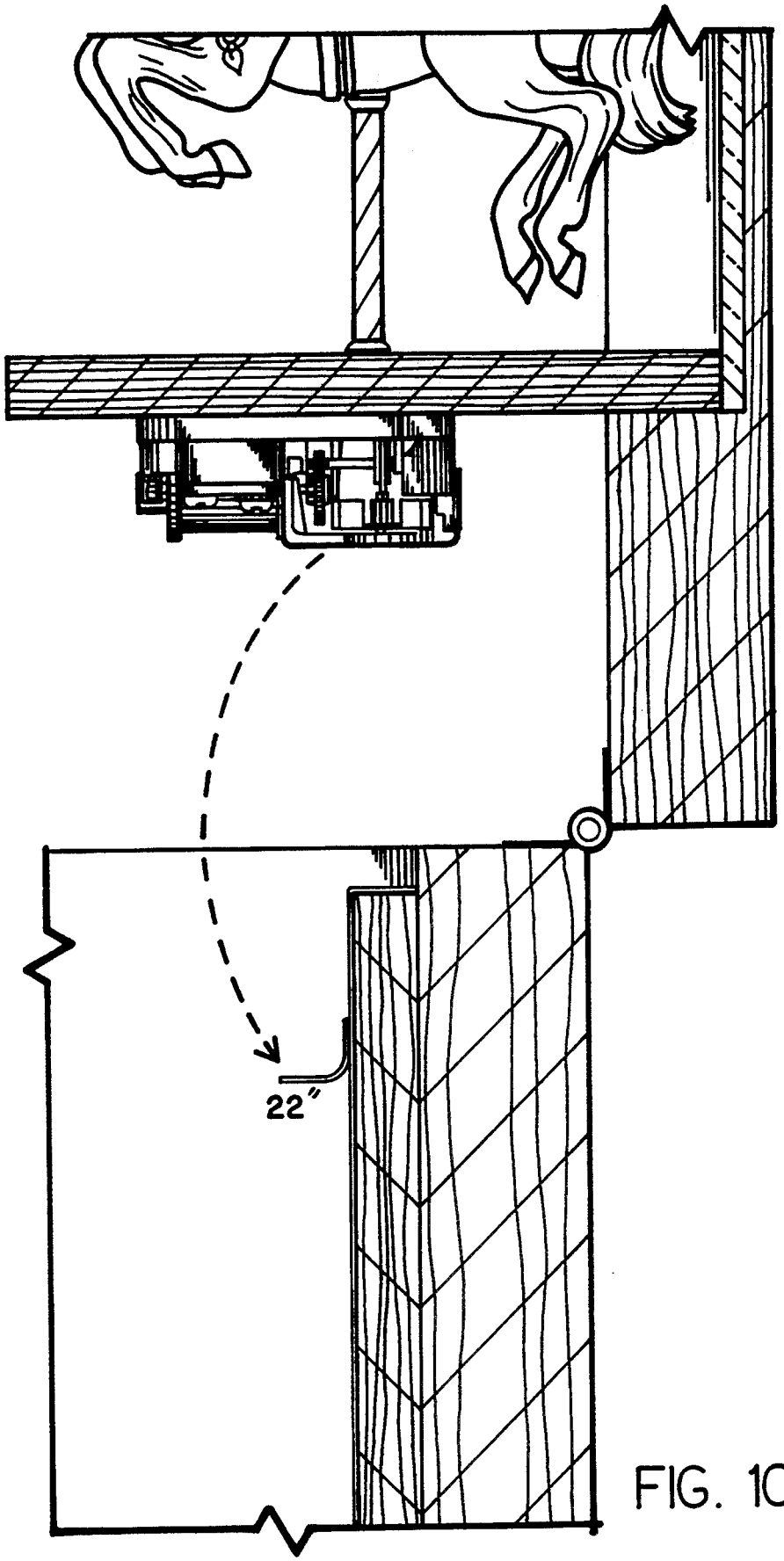
FIG. 10 is a cross section detail view of the second embodiment of the lid activated musical jewelry armoire.
Figure 11:
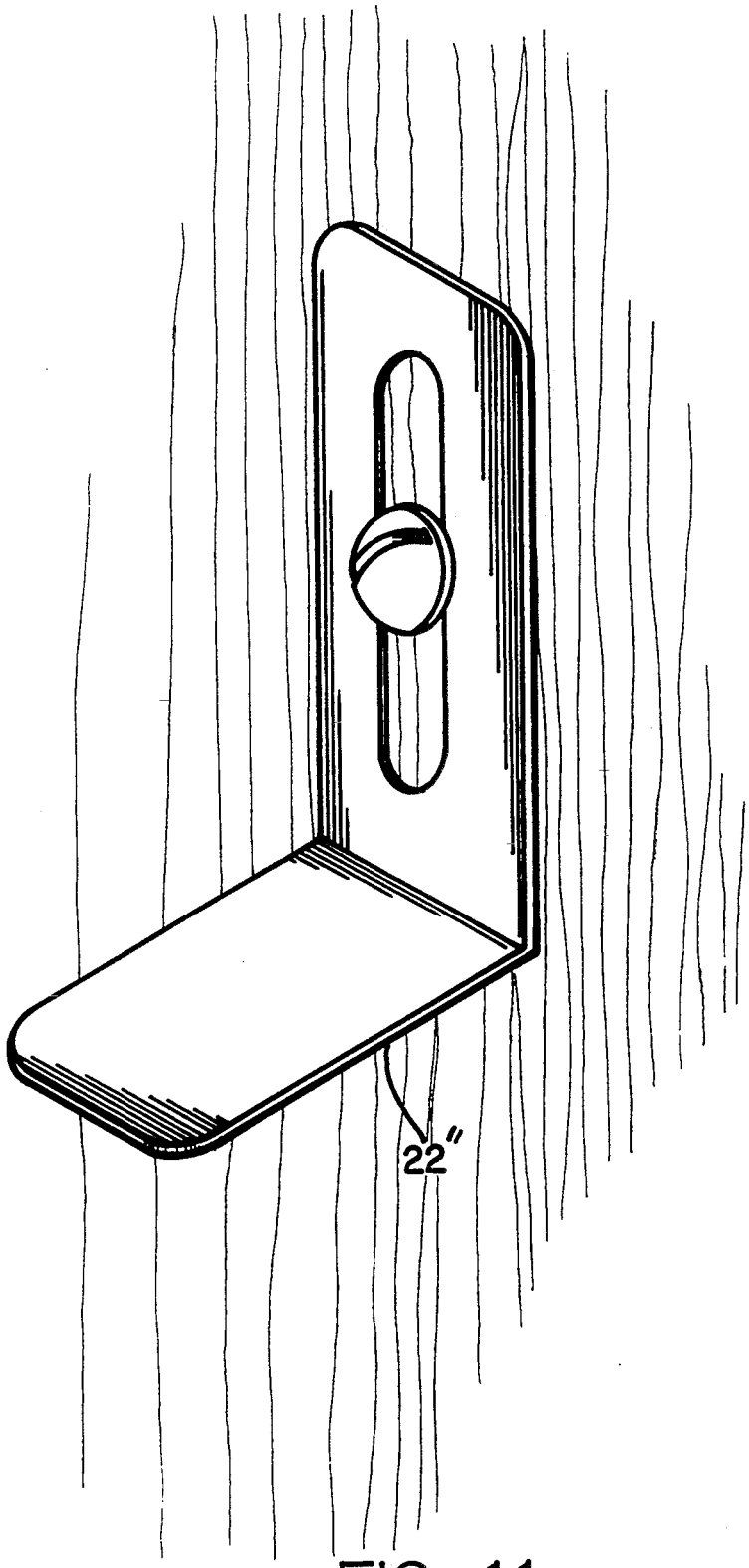
FIG. 11 is an isometric view of a version of the second embodiment of the stop and start means.

FIGS. 9 and 10 show a second embodiment for control arm 22'' which simply has the distal end portion of the J-shaped control arm permanently affixed to the inside surface of back housing member 39'. Here, control arm 22'' is simply a protruding member which interferes with stopper 25 when lid 38 is in its closed position. It should be noted that other configurations of control arm 22'' are possible. In fact, an adjustable position control arm 22'' is desirable to facilitate alignment of control arm 22'' with stopper 25. For example, providing an elongated opening in the bracket portion of control arm 22'' allows for accurate vertical adjustment to insure interference of control arm 22'' with stopper 25, as is shown in FIG. 11.

In use, the user winds musical movement 19 by rotating winding ring 37 about the axis of rotation of winding shaft 21. Once musical movement 19 is wound up, lid 38' is closed thereby deactivating musical movement 19. Whenever lid 38' is opened, J-shaped control arm 22' will spring to its on position to activate musical movement 19. To shut the music off, the user simply closes lid 38'.

While there is shown and described the present preferred embodiment of the invention, it is to be distinctly understood that this invention is not limited thereto but may be variously embodied to practice within the scope of the following claims.

We claim:

1. A musical article of furniture which comprises:

a housing;

a lid being pivotally attached to the housing between a generally horizontal closed position and a generally vertical open position, the lid having an inside surface which is unexposed when the lid is in the closed position;

a musical movement supporting member having a top surface and a bottom surface and being perpendicularly attached to the inside surface of the lid;

a musical movement being affixed to the bottom surface of the musical movement supporting member and having a rotating shaft extending through the musical movement supporting member;

an ornament shaft being axially aligned with and affixed to the rotating shaft;

an ornament being radially affixed to the ornament shaft; and musical movement stop and start means being attached to the housing and configured and positioned to interfere with the musical movement to stop the musical movement when the lid is in its closed position and start the musical movement when the lid is in its open position.

2. The musical article of furniture of claim 1 wherein the musical stop and start means further comprises a "J" shaped control arm being attached adjacent the musical movement and positioned to interfere with the housing when the lid is in its closed position and cause a distal end of the control arm to interfere with the operation of the musical movement.

3. The musical article of furniture of claim 2 wherein the musical movement further comprises:

a rotatable vertical stopper shaft extending down from the musical movement and having a radially disposed stopper extending therefrom being positioned to interfere with the distal end of the control arm when the lid is in its closed position, the vertical shaft further having a worm gear formed thereon;

a control shaft having a large control gear attached thereto being in meshed engagement with the worm gear, the control shaft also having a small control gear thereon; and a drum drive gear being in meshed engagement with the small control gear, the small control gear preventing the drum drive gear from rotating when the distal end of the control arm interferes with the stopper.

4. The musical article of furniture of claim 1 wherein the musical stop and start means further comprises a protruding member being attached to the housing and positioned to interfere with the operation of the musical movement.

5. The musical article of furniture of claim 4 wherein the musical movement further comprises:

a rotatable vertical stopper shaft extending down from the musical movement and having a radially disposed stopper extending therefrom being positioned to interfere with the distal end of the control arm when the lid is in its closed position, the vertical shaft further having a worm gear formed thereon;

a control shaft having a large control gear attached thereto being in meshed engagement with the worm gear, the control shaft also having a small control gear thereon; and a drum drive gear being in meshed engagement with the small control gear, the small control gear preventing the drum drive gear from rotating when the protruding member interferes with the stopper.

* * * * *